US008127377B2

(12) United States Patent
Ferrazzani

(10) Patent No.: US 8,127,377 B2
(45) Date of Patent: Mar. 6, 2012

(54) BATHTUB TRANSFER BENCH

(76) Inventor: Paul Ferrazzani, Norwood, MA (US)

( * ) Notice: Subject to any disclaimer, the term of this patent is extended or adjusted under 35 U.S.C. 154(b) by 392 days.

(21) Appl. No.: 12/418,092

(22) Filed: Apr. 3, 2009

(65) Prior Publication Data

US 2010/0251475 A1 Oct. 7, 2010

(51) Int. Cl.
*A47K 3/12* (2006.01)

(52) U.S. Cl. ..... 4/579; 4/560.1

(58) Field of Classification Search ..... 4/560.1–561.1, 4/565.1–566.1, 578.1–579
See application file for complete search history.

(56) References Cited

U.S. PATENT DOCUMENTS 4,472,844 A * 9/1984 Mace ..... 4/579
4,628,550 A * 12/1986 Walton ..... 4/560.1
5,335,377 A * 8/1994 Masyada et al. ..... 4/578.1
* cited by examiner

*Primary Examiner* — Charles Phillips
(74) *Attorney, Agent, or Firm* — James A. Italia; Italia IP

(57) ABSTRACT

A bathtub transfer bench includes a clamp member having a first arm for engaging an inner wall of a bathtub and a second arm for engaging an outer wall of the bathtub. A support member includes a substantially horizontal bench member and a pair of downwardly extending legs for supporting the bench member adjacent to the outer wall of the bathtub. A coupling mechanism releasably couples the support member to the clamp member.

4 Claims, 6 Drawing Sheets

BATHTUB TRANSFER BENCH

BACKGROUND OF INVENTION

This application relates generally to a bathtub transfer bench to assist handicapped or disabled persons in entering a bathtub. More specifically, this application relates to a bathtub transfer bench that assists handicapped or disabled persons in entering a bathtub without also obstructing the use of a shower curtain.

SUMMARY

Entering and exiting a bathtub is frequently a hazardous endeavor for handicapped or disabled persons as stepping over a bathtub wall and onto a frequently wet and slippery surface is quite challenging. This application discloses a bathtub transfer bench that assists handicapped or disabled persons in entering a bathtub without also obstructing the use of a shower curtain such that privacy of the individual in the bathtub is not compromised. The transfer bench is economical to produce, of simple construction and capable of mass production, but also capable of providing a user a safe and efficient means of entering a bathtub.

In particular, this application discloses a bathtub transfer bench comprising a clamp member having a first arm for engaging an inner wall of a bathtub and a second arm for engaging an outer wall of the bathtub; a support member having a substantially horizontal bench member and a pair of downwardly extending legs for supporting the bench member adjacent to the outer wall of the bathtub; and a coupling mechanism for releasably coupling the support member to the clamp member.

This application also discloses a bathtub transfer bench comprising: a clamp member having a first arm for engaging an inner wall of a bathtub and a second arm for engaging an outer wall of the bathtub; a support member adjustably coupled to the second arm of the clamp member; and a bench member hingedly secured to the support member, the bench member moveable between a first position and a second position.

This application further discloses a bathtub transfer bench comprising: a clamp member having a first arm for engaging an inner wall of a bathtub, a second arm for engaging an outer wall of the bathtub, and a bracket projecting from the second arm; a bench member hingedly secured to the bracket, the bench member moveable between a first position and a second position; and an adjustable support leg projecting downwardly from the bracket.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
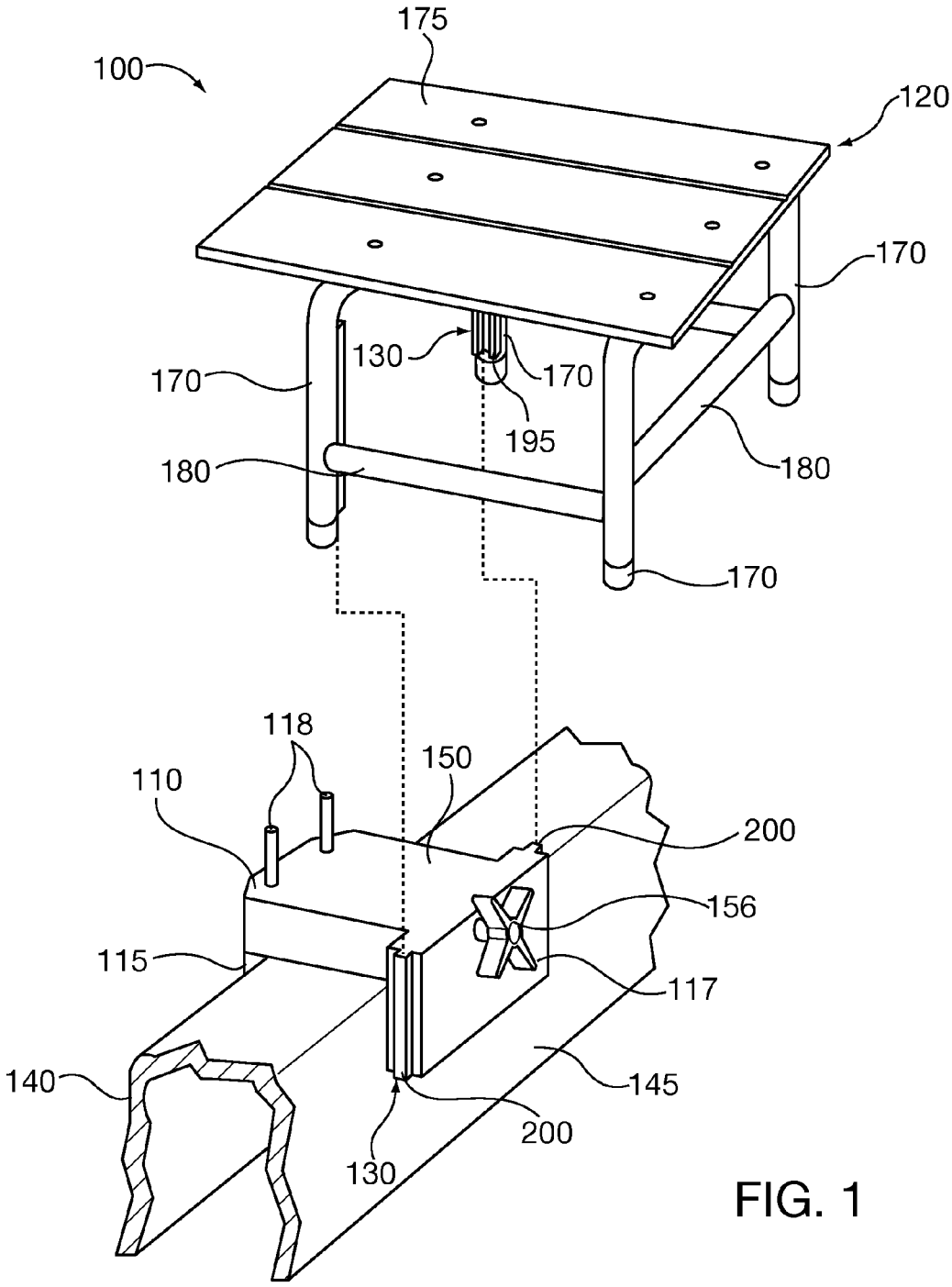
FIG. 1 is an exploded perspective view of a first embodiment of a bathtub transfer bench.
Figure 2:
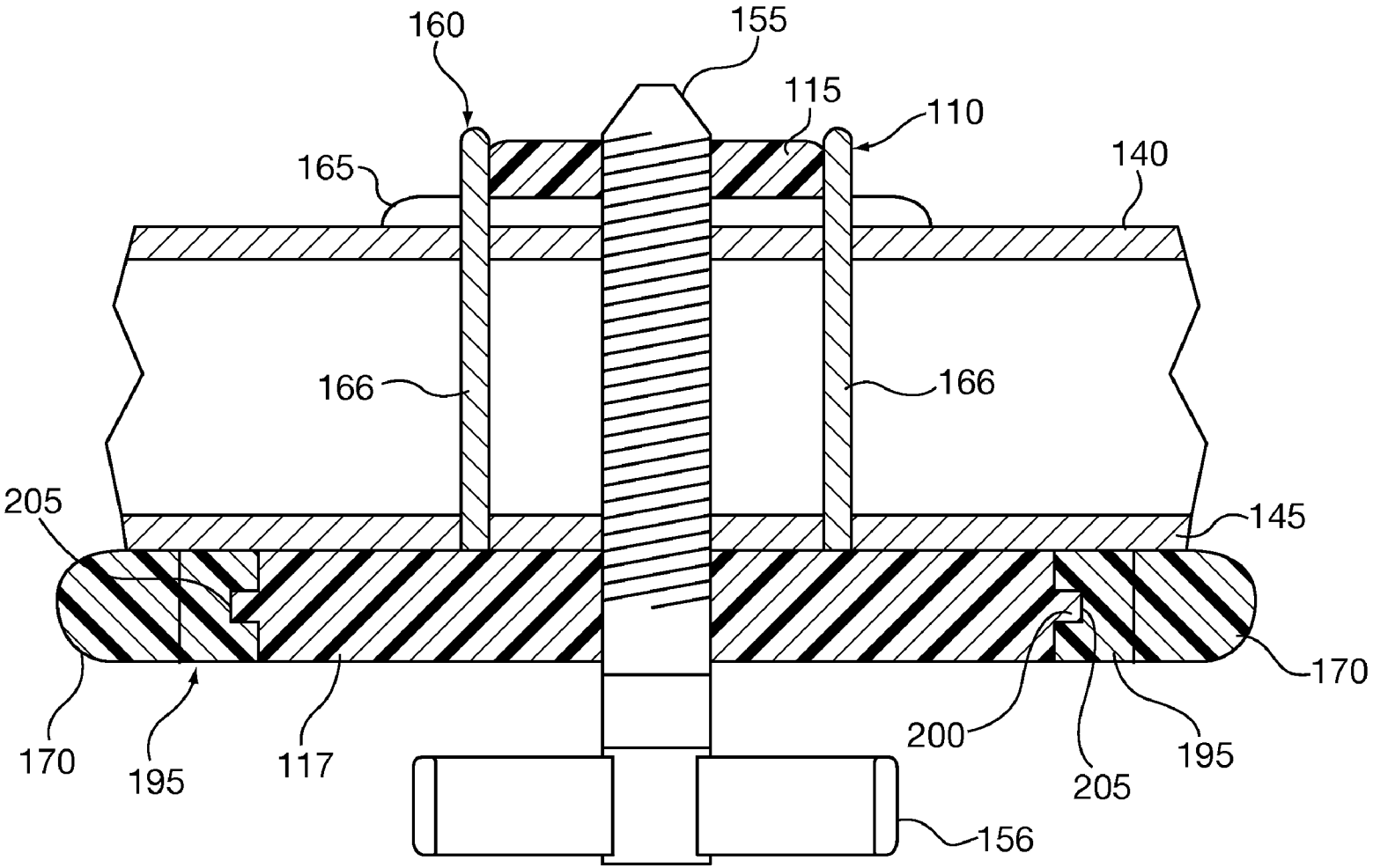
FIG. 2 is a partial cross-sectional top view of the bathtub transfer bench of FIG. 1.
Figure 3:
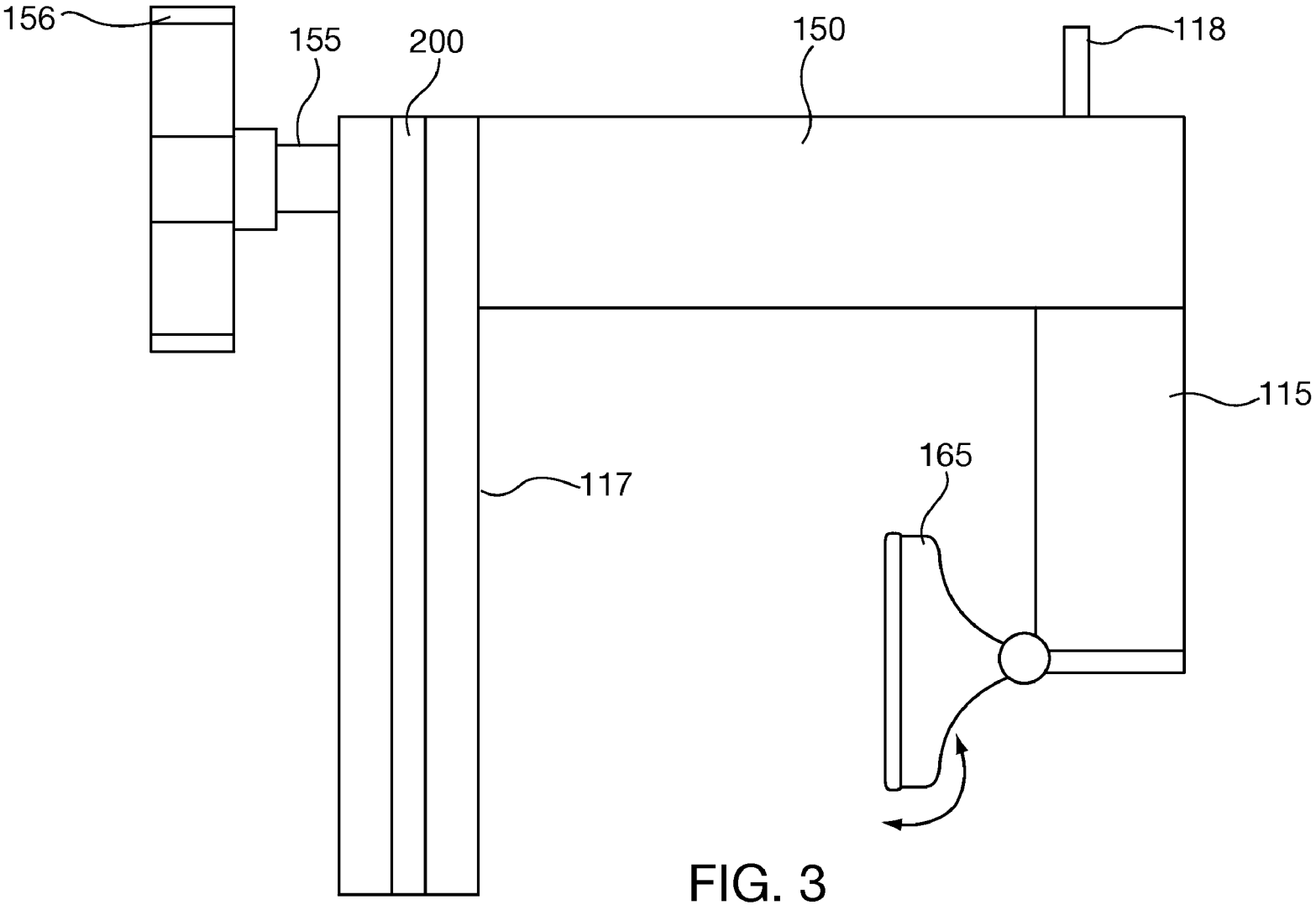
FIG. 3 is a side-view of the clamp member of FIGS. 1 and 2.

Referring now to FIGS. 1-3, a first embodiment of a bathtub transfer bench 100 is shown. The transfer bench 100 includes a clamp member 110, a support member 120, and a coupling mechanism 130 for releasably securing the support member 120 to the clamp member 110. The transfer bench 100, and each component thereof, may be formed from any suitable material, including but not limited to, metal, polymer, or composite.

The clamp member 110 includes a first arm 115 for engaging an inner wall 140 of a bathtub and a second arm 117 for engaging an outer wall 145 of the bathtub. The clamp member 110 may be adjustable such that the distance between the first arm 115 and the second arm 117 is selectively adjustable by the user such that the clamp member 110 may accommodate a variety of bathtubs having walls of differing widths (i.e. differing distances between the inner wall 140 and the outer wall 145). In the illustrative embodiment, the clamp member 110 includes an intermediate portion 150 that connects the first arm 115 and the second arm 117. A bolt member 155 extends from the second arm 117 to the first arm 115 and threadingly engages the first arm 115 such that rotation of the bolt member 155 adjusts the distance between the first arm 115 and second arm 117 as well as provides a clamping force between the first arm 115 and second arm 117 to secure the clamp member 110 to the bathtub wall. The bolt member 155 may include a grip 156 its distal end for easy rotation by a user.

The intermediate portion 150 of the clamp member 110 may include a track 160 defined by two track walls 166. The first arm 115 may be disposed within the track 160 such that the first arm 115 remains substantially parallel with the second arm 117 when the distance between the first arm 115 and second arm 117 is adjusted. Additionally, the first arm 115 may also include a pad member 165 hingedly secured near the bottom thereof such that the clamp member 110 may accommodate bathtubs with inner walls 140 that are not substantially vertical. Similarly, the second arm 117 may include a pad member (not shown) hingedly secured thereto such that the clamp member 110 may accommodate bathtubs with outer walls 145 that are not substantially vertical. In an alternative embodiment, the first arm 115 and second arm 117 may be connected by an extension spring such that the distance between the first arm 115 and second arm 117 may be adjusted by separating the first arm 115 and second arm 117, placing the clamp member 110 over a bathtub wall, and allowing the extension spring to provide the clamping force about the bathtub wall. Nevertheless, it will be appreciated that distance between the first arm and second arm, and the clamping force provided thereby, may be accomplished by any suitable means and is not limited to the forging illustrative embodiments. Alternatively, the distance between the first and second arms may be fixed whereby the clamp member is forced over a bathtub wall and friction between the first arm and inner wall as well as friction between the second arm and the outer wall assist in affixing the clamp member to the bathtub wall. Additionally, as will be discussed further below, the clamp member 110 includes one or more anti-tip rods 118 for supporting a bench member 175 above the clamp member 110. The anti-tip rods 118 may be threaded and vertically adjustable such that they may be adjusted to engage the underside of the bench member 175.

The support member 120 includes a plurality of downwardly extending leg 170 that support a bench member 175 affixed thereto. In one embodiment, the bench member 175 may have a slidable extension (not shown) such that the bench may be selectively extended further into the bathtub to further assist a user as he or she enters the bathtub. The legs 170 are operable to be placed adjacent to the outer wall 145 and support the bench member 175. While the illustrative embodiment shows four downwardly extending legs 170, it will be appreciated that the support member 120 may include any suitable number of legs. In addition, the bench member 175 may be affixed to the legs 170 via any suitable affixing means, including, but not limited to, welding, mechanical fasteners, adhesive, bonding, or any other suitable affixing means. Also, the support member 120 may also include one or more stabilizing bars 180 that extend between adjacent legs 170.

The coupling mechanism 130 is operable to releasably secure the support member 120 to the clamp member 110. In the illustrative embodiment, the coupling mechanism 130 comprises at least one groove member 195 coupled to at least one leg 170 of the support member 120. The groove member 195 includes a longitudinal groove 205 therein. In an alternative embodiment, the each leg includes a groove. The clamp member 110 includes one or more tongues 200 wherein each tongue 200 is adapted to be received by the groove 205 of the groove member 195. In an alternative embodiment, the clamp member 110 includes one or more groove members and/or grooves and each leg 170 includes the corresponding tongue (s).

In operation, the clamp member 110 is coupled to the bathtub wall such that the first arm 115 engages the inner wall 140 of the bathtub and second arm 117 engages the outer wall 145 of the bathtub. A user may then rotate the bolt member 155 via rotation of the grip 156 such that the first arm 115 is drawn towards the second arm 117 thereby clamping the clamp member 110 about the bathtub wall. The support member 120 is then placed above the second arm 117 of the clamp member 110 such that each tongue 200 is aligned with a corresponding groove 205 of a groove member 195. The user may then supply downward pressure to the bench member 175 whereby each tongue 200 is disposed within a corresponding groove 205 and the bench member 175 is supported by each leg 175. When each tongue 200 and groove 205 are engaged and the bench member 175 supported by each leg 175, the bench member 175 extends from the support member 120 and into the bathtub. If necessary, the anti-tip rods 118 may then be rotated, or otherwise adjusted, so as to provide support to the bench member 175 above the clamp member 110. The user may then sit on the bench member 175 and slide, or otherwise move, into the bathtub. The user may then lift the bench member 175 to disengage the groove(s) 205 and tongue(s) 200 and place the support member 120 off to the side. A shower curtain may then be closed for privacy. Once the user is finished in the bathtub, the support member 120 may re-engage the clamp member 110, as described above, and the user may use the bench member 175 to exit the bathtub. This process, however, is not necessary to the invention, as a user may simply allow the inner shower curtain to pass by the clamp member 110. If an outer shower curtain is being used, the user may merely choose to position this portion of the curtain on top of the transfer bench 100.

Figure 4:
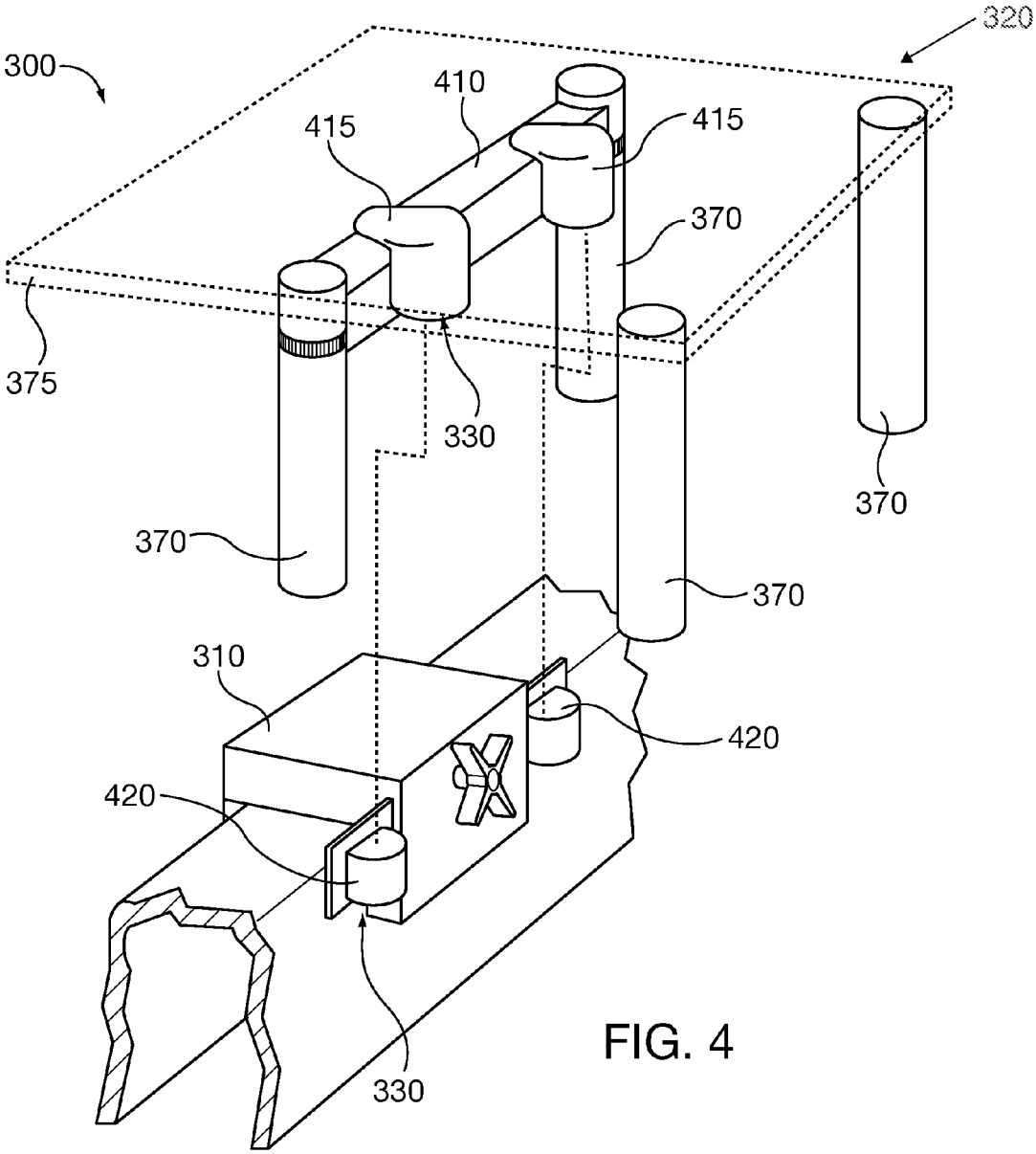
FIG. 4 is an exploded perspective view of a second embodiment of a bathtub transfer bench.

Referring now to FIG. 4, a second illustrative embodiment of a bathtub transfer bench 300 is shown. The transfer bench 300 is analogous in most respects to the transfer bench 100 of FIGS. 1-3 and a correlation of parts is generally indicated in this embodiment by indexing the numerals in FIGS. 1-3 by 200. In the present embodiment, the coupling mechanism 330 includes a rail 410 coupled to at least two legs 370 of the support member 320. The rail 410 includes at least one tube member 415 projecting downwardly therefrom. The coupling mechanism 330 also includes at least one bracket 420 coupled to the clamp member 310. Each bracket 420 is adapted to releasably receive a corresponding tube member 415. While the tube member 415 and bracket 420 are shown as having circular cross-sections, it will be appreciated that each may have any suitable cross-section, including, but not limited to, elliptical, triangular, square, rectangular, hexagonal, octagonal, etc. Thus, the support member 320 may be situated in a bathtub loading/unloading position by disposing each tube member 415 within a corresponding bracket 420 thereby allowing a user to enter or exit the bathtub via the bench member 375. In order to close a shower curtain, the user may lift the bench member 375 to disengage the tube member(s) 415 and bracket(s) 420. Again, it should be noted that this process is not entirely necessary, as the user may opt to merely position the shower curtain(s) around the invention. While the coupling mechanism has been illustrated in several embodiments, it will be appreciated that any suitable mechanism for releasably securing the support member to the clamp member may be employed. For example, the support member and clamp member may each have one or more magnets thereby providing a releasable coupling of the support member to the clamp member. Further, the embodiment shown in FIG. 4 may also utilize anti-tip rods, similar to the anti-tip rods 118 as shown in FIG. 1, to support a bench member.

Figure 5:
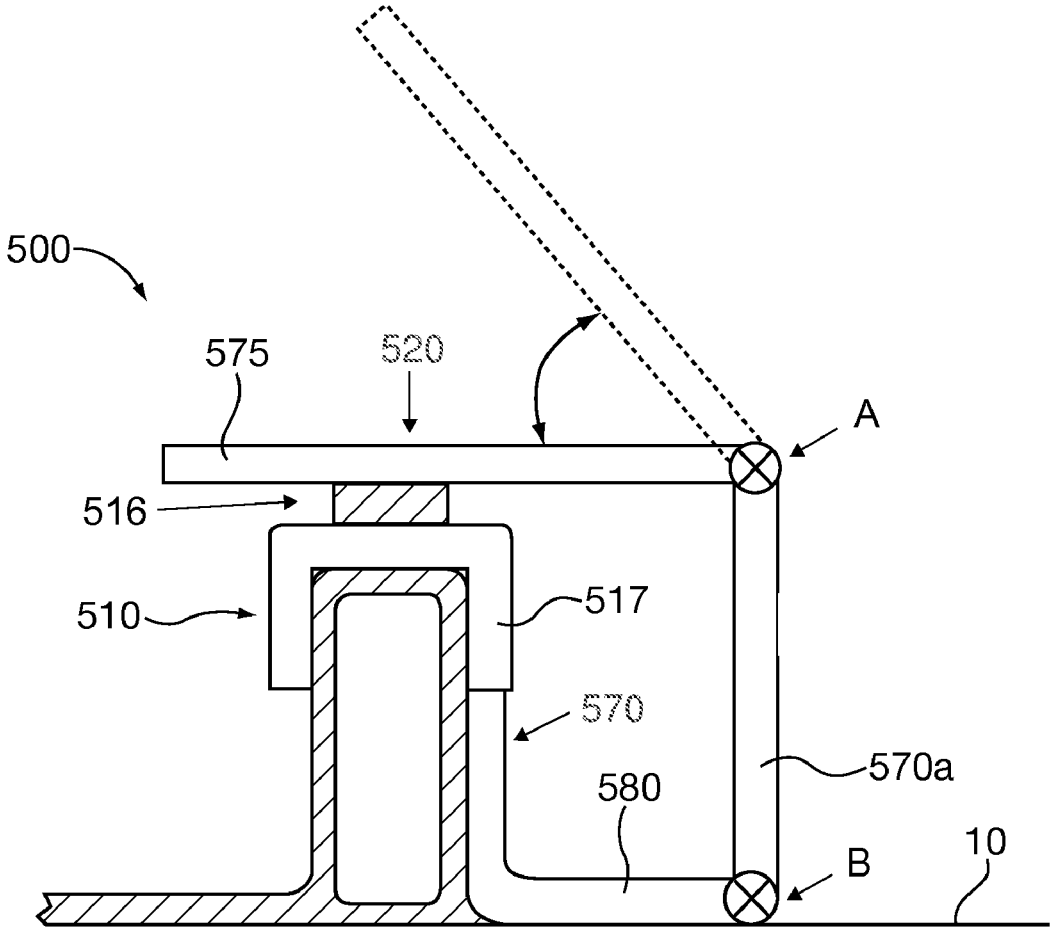
FIG. 5 is a side view of a third embodiment of a bathtub transfer bench.

Referring now to FIG. 5, another illustrative embodiment of a bathtub transfer bench 500 is shown. The transfer bench 500 is analogous in most respects to the transfer bench 100 of FIGS. 1-3 and a correlation of parts is generally indicated in this embodiment by indexing the numerals in FIGS. 1-3 by 400. In the present embodiment, at least one leg 570 is adjustably coupled to the second arm 517 of the clamp member 510 such that the height of the support member 520 may be adjusted to accommodate a variety of bathtubs having wall of different heights. In the illustrative embodiment, the legs 570 telescopically engage the second arm 517 to provide such adjustability; however, it will be appreciated that any suitable means or mechanism for adjustably coupling at least one leg 570 to the second arm 517 may be employed.

In one embodiment, the bench member 575 is hingedly coupled to the upper end of at least one leg 570 (such as at point A) whereby the bench member 575 is movable between a bathtub-loading (or unloading) position and a curtain-closing position. In the bath-tub loading position, the bench member 575 is substantially horizontal and extends into the bathtub such that a user may enter or exit the bathtub as previously described. In the curtain-closing position, the bench-member 575 is rotated from the bench-loading position such that bench member 575 is at an angle relative to the ground 10. In the curtain-loading position, the bench member 575 may be at any suitable angle relative to the ground 10 that permits the shower curtain close without any obstruction by the bench member 575. In one embodiment, the hinge connection is a ratcheted-hinge connection such that the bench member 575 will remain in the curtain-closing position unless or until a user applies s sufficient downward force thereon. In an alternative embodiment, one or more outer legs **570*a* may be hingedly secured to a stabilizing bar 580 (such as at point B) whereby both the bench member 575 and the outer legs 570*a* rotate between a bathtub-loading position and a curtain-closing position as previously described. Also, in one embodiment, the upper surface of the intermediate portion of the clamp member 510 may include a bumper member 516 for supporting the bench member 575 in a substantial horizontal position when the bench member 575** is situated in the bathtub loading position.

Figure 6:
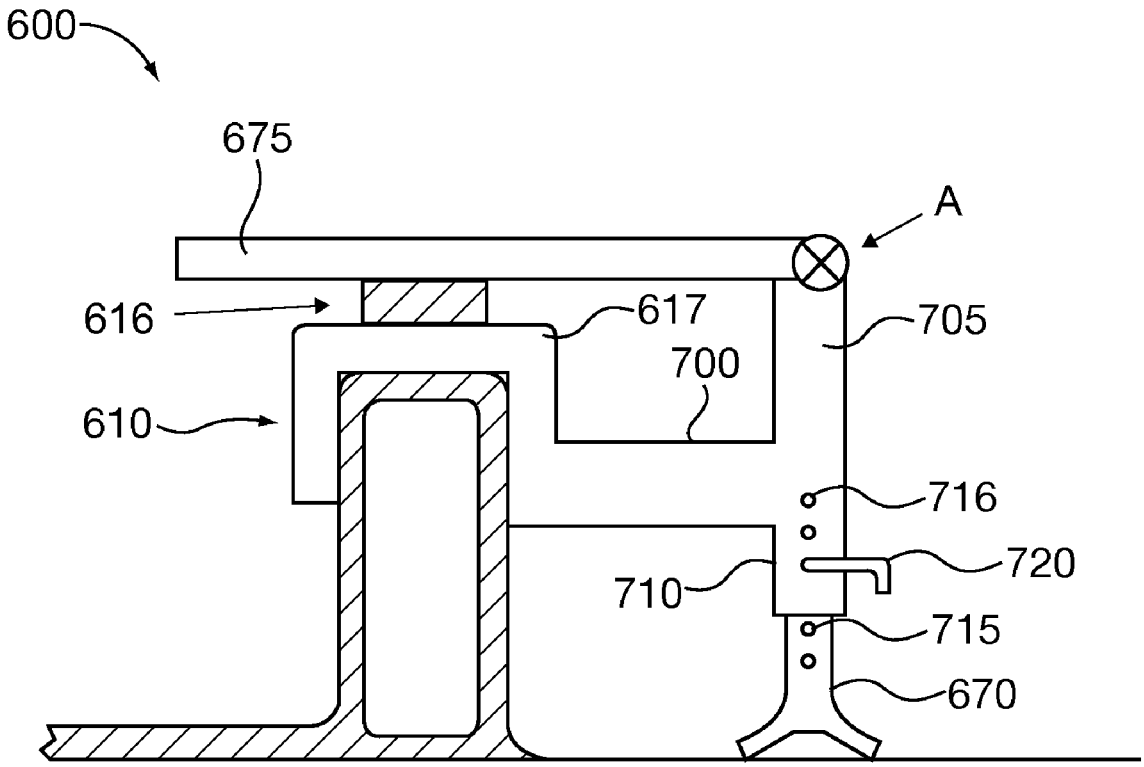
FIG. 6 is a side view of a fourth embodiment of a bathtub transfer bench.

Referring now to FIG. 6, another illustrative embodiment of a bathtub transfer bench 600 is shown. The transfer bench 600 is analogous in most respects to the transfer bench 500 of FIG. 5 and a correlation of parts is generally indicated in this embodiment by indexing the numerals in FIG. 5 by 100. In the present embodiment, one or more brackets 700 extend substantially normal from the second arm 617 of the clamp member 610. However, it will be appreciated that each bracket 700 may be at any suitable angle relative to the second arm 617. Each bracket 700 includes an upwardly extending portion 705 and a downwardly extending portion 710. The bench member 675 is hingedly secured to each upwardly extending portion 705 (such as at point A) and is thereby movable between a bench-loading position and a curtain-closing position as previously discussed. Also, in one embodiment, the upper surface of the intermediate portion of the clamp member 610 may include a bumper member 616 for supporting the bench member 675 in a substantial horizontal position when the bench member 675 is situated in the bathtub loading position.

In addition, each downwardly extending portion 710 is adapted to releasably receive a corresponding support leg 670. The support leg(s) 670 may be adjusted within the downwardly extending portion 710 such that the height of the bathtub transfer bench 600 may be adjusted to accommodate bathtubs having bathtub walls of differing heights. In the illustrative embodiment, each leg 670 has a plurality of apertures 715 therein and each downwardly extending portion 710 has a plurality of apertures 716 therein. The leg 670 may be adjusted to an appropriate height within the downwardly extending portion 710 such that at least one aperture 715 of the leg 670 is aligned with an aperture 716 of the downwardly extending portion 710 whereby a pin 720 may be disposed through both apertures 715, 716 to secure the leg 670 in the desired position. It will, however, be appreciated that any suitable mechanism or means may be employed to maintain the support leg 670 in the desired position, and may include, but is not limited to an arrangement whereby the leg 670 threadedly engages the downwardly extending portion 710.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A bathtub transfer bench disposed to engage a bathtub having an inner wall, an outer wall and an intervening rim, comprising:

a clamp member having a first arm for engaging an the inner wall of a bathtub and a second arm for engaging an the outer wall of the bathtub;

a support member having a substantially horizontal bench member and a pair of downwardly extending legs for supporting the bench member adjacent to the rim of the bathtub; and a coupling mechanism for releasably coupling the support member to the clamp member comprising a rail coupled to the legs of the support member and at least two tube members depending downwardly from the rail, and at least two brackets coupled to the clamp member and adapted to releasably receive a corresponding tube member.

2. The bathtub transfer bench of claim 1 wherein the clamp is adjustable such that the distance between the first and second arms is selectively adjustable.

3. The bathtub transfer bench of claim 1 further comprising a bolt member, wherein the bolt member extends from the second arm and threadingly engages the first arm such that the distance between the first and second arms is selectively adjustable via rotation of the bolt member.

4. The bathtub transfer bench of claim 1, further comprising a plurality of anti-tip rods disposed to engage the underside of the bench member.

* * * * *